US005167046A

United States Patent [19]

Benson

[11] Patent Number: 5,167,046

[45] Date of Patent: Dec. 1, 1992

[54] INDUCTION VACUUM

[76] Inventor: Ronald C. Benson, P.O. Box 988, Minneapolis, Minn. 55458

[21] Appl. No.: 506,836

[22] Filed: Apr. 9, 1990

[51] Int. Cl.[5] ..... A47L 5/18; F04F 5/00

[52] U.S. Cl. ..... 15/409; 417/151; 417/176

[58] Field of Search ..... 15/409; 417/151, 196, 417/178

[56] References Cited

U.S. PATENT DOCUMENTS

| | | | |
|---|---|---|---|
| 2,191,717 | 2/1940 | Jeffery | 15/409 X |
| 2,357,266 | 8/1944 | Malcolm | 417/196 X |
| 2,623,474 | 12/1952 | Friedmann | 417/178 |
| 2,937,802 | 5/1960 | Fisher | 15/409 X |
| 4,562,612 | 1/1986 | Williams et al. | 15/409 |
| 4,632,649 | 12/1986 | Segebrecht et al. | 417/151 |
| 4,846,617 | 7/1989 | Ehrhardt | 417/151 X |
| 4,898,517 | 2/1990 | Eriksen | 417/151 |

FOREIGN PATENT DOCUMENTS 1013842 8/1957 Fed. Rep. of Germany ..... 15/409

*Primary Examiner*—Chris K. Moore

*Attorney, Agent, or Firm*—Robert A. Elwell; Harold D. Jastram

[57] ABSTRACT

An induction vacuum includes a cylindrical body having an inlet plate, an outlet plate, and a vacuum connector; a nozzle detachably mountable to the inlet plate, a mixing tube detachably mountable to the outlet plate and an exhaust bell detachably mountable to the mixing tube. An induction vacuum kit includes a body, a plurality of nozzles, a plurality of mixing tubes, and at least one exhaust bell. The nozzles and mixing tubes may include identifying indicia and the kit may include instructions recommending nozzle and mixing tube combinations for achieving different vacuum properties.

11 Claims, 2 Drawing Sheets

FIG. 1
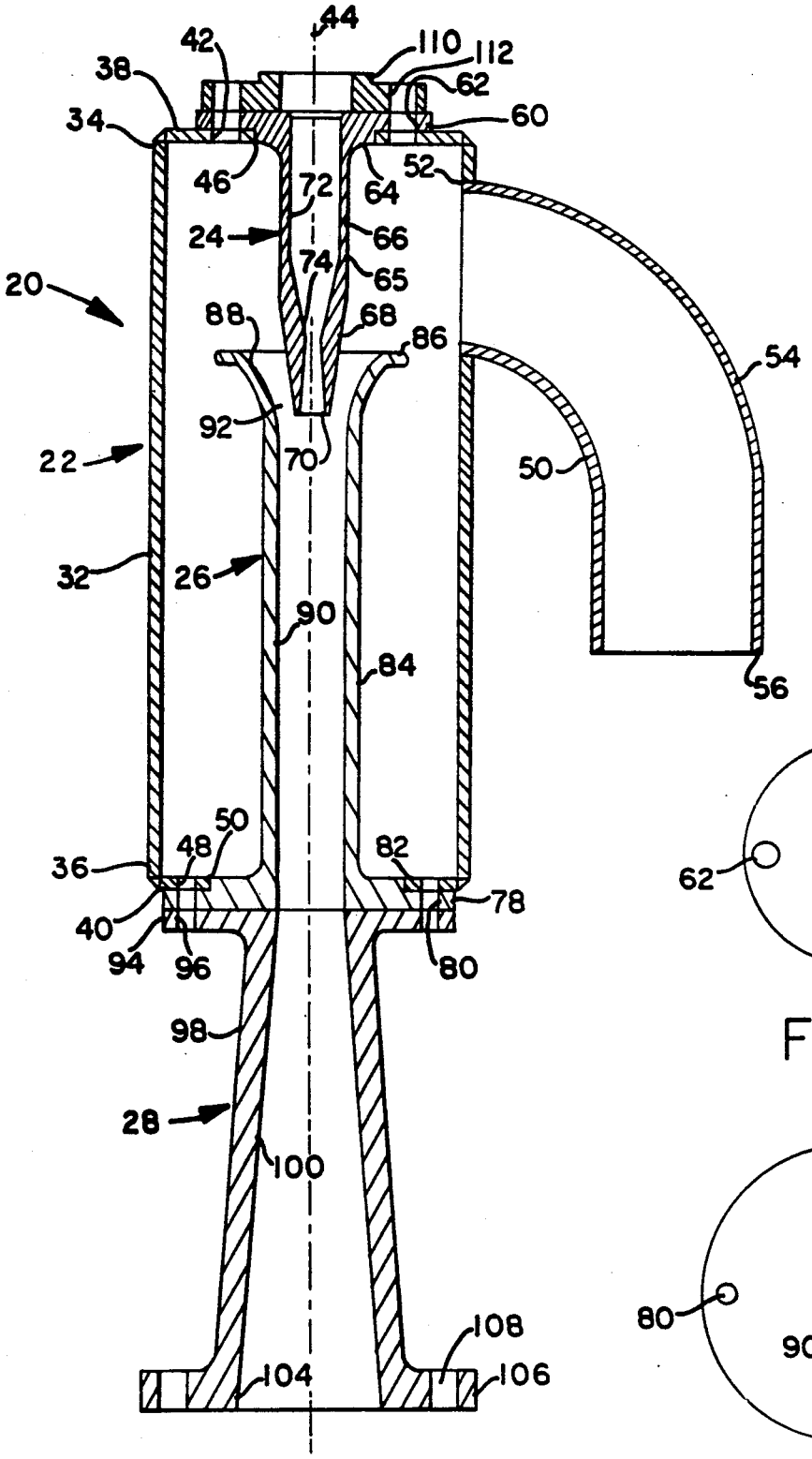
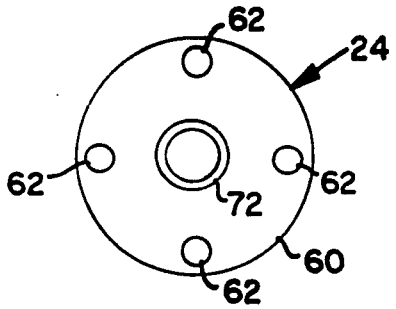
FIG. 2
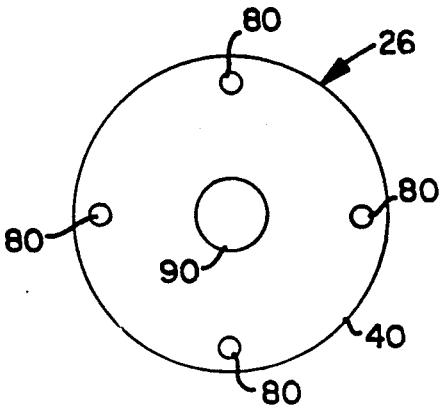
FIG. 3

INDUCTION VACUUM

The present invention relates to surface preparation equipment and in particular to induction vacuums.

In the sandblasting industry, discharged abrasive particles and debris particles dislodged from the surface being sandblasted are often retrieved. In recent years, the health and environmental dangers of lead have been increasingly recognized. Thus, retrieval is especially important when the sandblasting debris results from a surface bearing lead-based paint. The retrieval process, when performed simultaneously with sandblasting, also enables control of dust including lead.

Air-compressors are typically employed in sandblasting. Induction vacuums also utilize a high pressure air supply to generate a vacuum. Induction vacuums therefore tend to offer an effective and compatible method for retrieving sand and particles.

Currently available induction vacuums are expensive, complex in design, difficult to maintain and variable in efficiency. An advance in induction vacuum design which reduces capital cost, speeds assembly and maintenance, and increases versatility would be highly desirable.

SUMMARY OF THE INVENTION

An induction vacuum of the present invention includes a body, a nozzle, a mixing tube and an exhaust bell. The body has an inlet plate, an outlet plate, and a vacuum connector and, preferably, is generally cylindrical. The nozzle is detachably mountable to the inlet plate and preferably includes a mounting plate and a protuberance having an axial passage leading to a discharge orifice. The mixing tube is detachably mountable to the outlet plate and preferably includes a mounting plate and a tubular portion, terminating in a flair to provide an axial passage. The exhaust is detachably mountable to the mounting plate of the mixing tube and preferably shares a common means for mounting with the mixing tube. Most preferably the common means for mounting the mixing tube and exhaust bell include four threaded studs projecting from the outlet plate and a four-bolt hole pattern in the mounting plates of the mixing tube and exhaust bell. A preferred means for mounting the nozzle also includes four threaded studs projecting from the inlet plate and a four-bolt hole pattern in the mounting plate of the nozzle.

The combination of the body, nozzle and mixing tube along with the mounting method and dimensions, causes the nozzle orifice and mixing tube intake flair to achieve a desired and effective alignment within the body, such that a high pressure air flow from the orifice into the mixing tube generates a vacuum within the body. The vacuum is used by allowing an air flow into the body through the vacuum connector.

The present invention also envisions a kit including a body, a plurality of nozzles, a plurality of mixing tubes and at least one exhaust bell. Preferably, the nozzles and mixing tubes bear indicia for identifying the passage dimensions of the various nozzles and mixing tubes. Because the nozzles may be interchanged and the mixing tubes may be interchanged, it is possible to select particular members of the plurality to provide particular characteristics allowing an effective matching of the high pressure air supply and desired vacuum. Most preferably, an instruction set, outlining suggested combinations is included with the kit.

BRIEF DESCRIPTION OF THE DRAWINGS

FIG. 1 is a longitudinal cross-section of a preferred embodiment of the present invention;

FIG. 2 is an end view of the nozzle of the present invention;

FIG. 3 is an end view of the mixing tube of the present invention; and

DETAILED DESCRIPTION OF THE PREFERRED EMBODIMENTS

Figure 4:
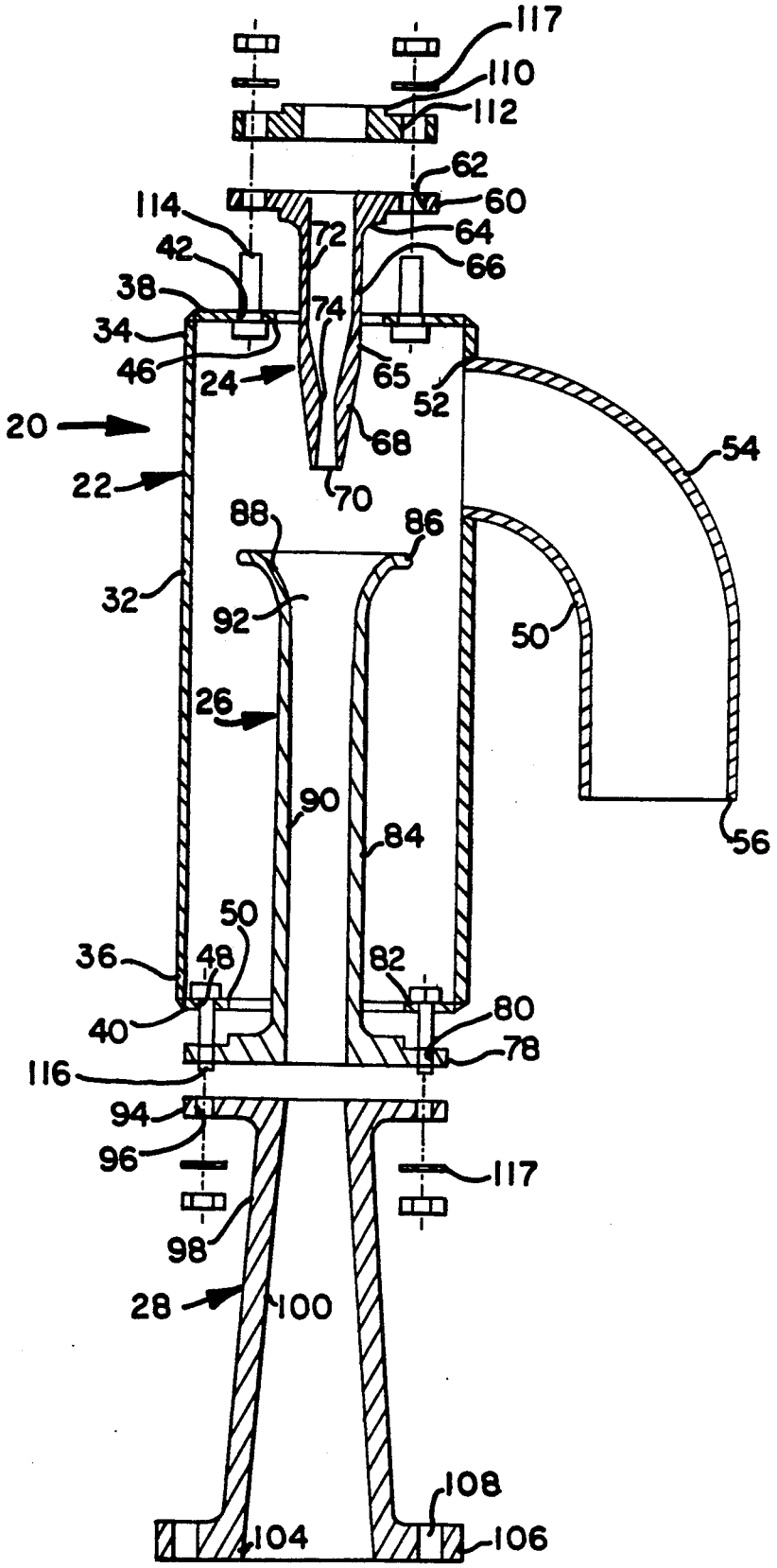
FIG. 4 is a partially exploded longitudinal cross-section of a preferred embodiment.

A preferred embodiment of an induction vacuum of the present invention is shown in FIG. 1 at 20. The induction vacuum 20 includes 4 components: a body 22, a nozzle 24, a mixing tube 26, and an exhaust bell 28.

The body 22 includes a cylindrical wall 32 having a first or input end 34 and a second, or discharge end 36. The input end 34 is attached to an inlet plate 38 and the discharge end 36 is attached to an outlet plate 40. The inlet plate 38 has a 4-bolt mounting pattern 42 concentrically arranged about a longitudinal axis 44 of the body 20. Additionally, the inlet plate 38 includes a central aperture 46. Together, the 4-bolt arrangement 42 and aperture 46 allow for mounting of the nozzle 24. The outlet plate 40 includes 4-bolt holes 48 concentrically arranged about the axis 44. The outlet plate 40 further includes a centrally located aperture 50 concentrically located about the axis 44. The bolt holes 48 and central aperture 50 of outlet plate 40 serve to allow insertion and mounting of the mixing tube 26.

Preferably, the cylindrical wall 32 of the body 20 may be provided from a section of 8 inch schedule 40 steel pipe. The inlet and outlet plates 38 and 40 are also preferably formed of steel and are permanently attached to the ends 34 and 36 of the body 22 preferably by welding. The wall 32 also includes an aperture 52. Preferably the aperture 52 is located adjacent the inlet plate 38. A vacuum connecting tube 54 is permanently attached to the aperture 52 of the cylindrical wall 32. Preferably the vacuum connector is also permanently attached to the wall 32 by welding. The preferred vacuum connector additionally includes an opposite end 56 and a bend 50 opposite end 56 in a generally parallel relationship with the wall 32 and directed generally toward the outlet plate 40.

The nozzle 24 includes a mounting plate 60 including a 4-bolt mounting pattern 62 with substantially the same spacing and sizing of bolt holes as the bolt pattern 42 of inlet plate 38. The end plate 60 further includes a short segment of cylindrical projection 64 concentrically arranged about the longitudinal axis of the nozzle 24. The radius of the cylindrical projection 64 is such that it will snugly fit within the aperture 46 of the inlet plate 38. The 4-bolt pattern 62, as shown in FIG. 2, and the cylindrical projection 64 of the nozzle 24, as shown in FIG. 1, enable mounting of the nozzle to the inlet plate 38 such that the longitudinal axis of the nozzle 24 becomes coincident with the longitudinal axis 44 of the body 22. The nozzle 24 further includes a protuberance 65 axially extending from the cylindrical projections 64 and having a hollow cylindrical wall 66 leading to a frustoconical surface 68 and a discharge orifice end 70. Within the nozzle 24 is an axial passage 72 and a constriction 74 preferably located within the frustoconical portion 68 of the nozzle 24. The passage 72 also includes a slight expansion or increase in bore past the constriction 74 and extending to the discharge orifice 70.

The mixing tube 26 includes a circular mounting plate 78. The mounting plate 78 also includes a 4-bolt pattern 80, as shown in FIG. 3, and a concentrically arranged cylindrical extension 82, as shown in FIG. 1. The radius of the extension 82 is such that it will closely fit within the aperture 50 of the outlet plate 40. The arrangement of the bolt holes 80 is such that they may be aligned with the bolt holes 48 of the outlet plate 40 while the cylindrical portion 82 is fit snugly within the aperture 50 so as to mount the mixing tube 26 generally within the body 22 with the longitudinal axis of the mixing tube 26 coincident with the axis 44 of the body 22. Projecting from the raised portion 82 is an axially extending central tube 84 which terminates in an intake flair or bell 86. The interior passage created by the tube 84 and bell 86 includes a flared mouth 88 beginning at the belled terminus 86 and leading to a cylindrical inner wall 90.

When the nozzle 24 and the mixing tube 26 are both appropriately mounted upon the body 22, the discharge orifice 70 of the nozzle 24 is located concentrically within the mixing tube 26 at a point 92 where the flared mouth 88 meets the inner wall 90.

The exhaust bell 28 also includes a circular mounting plate 94 having a 4-bolt concentrically arranged mounting pattern 96 and a frustoconical shaped wall 98 enclosing a frustoconical passage 100 which is concentrically arranged about the longitudinal axis of the exhaust bell 28 and increases in diameter from the mounting plate 94 to a terminus 104. A cylindrical flange 106 also having a 4-bolt pattern 108 projects radially outward at the terminus 104.

The radius of the greatest extent of the flair 86 is such that it may pass through the aperture 50. Thus, allowing the mixing tube 26 to be fully removed from its assembled position within the body 22.

A standard pipe flange 110, including a 4-bolt hole pattern 112 which matches the 4-bolt pattern of the inlet plate 38 and the nozzle 24 may be provided for placement over the nozzle 24.

Preferably, knurled studs 114 and 116, as shown in FIG. 4, are provided for detachable mounting of the nozzle 24 and the pipe flange 110 to the inlet plate 38 and the mixing tube 26 and exhaust bell 28 to the outlet plate 40. The knurled studs 114 and 116 are arranged within the inlet and outlet plates 38 and 40 such that the heads of the studs 114 and 116 are within the body 22 and the threaded portions of the studs are directed outward and project from the 4-bolt pattern on the inlet and outlet plates 38 and 40 to facilitate convenient mounting of the plates 60, 110, 78 and 94. The various components may be secured by tightening hexnuts onto the protruding studs and optionally including lockwashers 117. Because the nozzle 24 and mixing tube 26 are each radially symmetrical and the four studs projecting from each of the inlet and outlet plates 38 and 40 are also radially symmetrical about the axis 44 of the body 22, assembly merely involves alignment of the mounting plate 60 or 78 with the studs. That is, proper alignment is achieved in any of the four rotations in which the holes align with the studs.

The induction vacuum functions by provision of a high-pressure air source to the nozzle 24, preferably by a threaded connection within the pipe flange 110. A flow of air from the pipe flange 110 through the nozzle 24 and continuing through the cylindrical passage 90 and onward through the interior passage 100 of the exhaust bell 28, creates a region of low-pressure within the mixing tube 26. In response, suction is created drawing air or other materials from the interior of the body 22 past the flared bell 86 and inward through the flared passage 88 to join the main flow of air within the cylindrical passage 90. This in turn creates suction and typically air flow within the suction tube 54 and toward the passage 90. The suction may be used to pick up material such as sand or paint chips. Materials, such as sand or paint chips, entrained within an air flow traveling through the vacuum connection 54 toward the mixing tube 26 may either continue to travel through the induction vacuum 20 or alternatively and preferably may be trapped by well-known procedures in this art, such as expansion chambers or filters prior to entering the induction vacuum 20.

The induction vacuum 22 may be conveniently mounted on a frame, for example the frame of an air compressor, by employing "U" bolts about the body. For a body having an 8-inch diameter, two 8-inch "U" bolts are satisfactory.

The present invention offers the advantage, relative to the prior art, of easy maintenance, simple assembly, relatively few parts, and low-cost production. Additionally, the induction vacuum of the present invention is relatively lightweight, due to its cast aluminum parts. Production costs are relatively low since the only machining typically required in production of the cast aluminum parts is machining on the faces of the nozzle mounting plate 60 and the wall of the cylindrical extension 46, as well as machining of the adjoining faces of the mixing tube 26 and exhaust bell 28.

Preferably, the nozzle 24, mixing tube 26 and exhaust bell 28 are prepared by casting aluminum. Only minor drilling and machining of a few faces is required for additional production of these parts. Preferably, the portions of the mounting plate 60 which contact the inlet plate 38 and the pipe flange 110 should be machined to minimize any air leakage. Similarly, it is preferable to machine the portions of the mounting plate 78 which contact the outlet plate 40 and the exhaust bell 28. Similarly, the portion of the exhaust bell 28 contacting the mounting plate 78 should be machined.

An additional advantage of the present invention, particularly when minor matching to promote a leak-free fit, relative to the prior art, includes the lack of any requirement for O-rings during assembly. Optionally, the faces may be coated with a silicon caulking prior to assembly.

Suitable constriction 74 may be from about 0.200 inches to about 0.750 inches. Suitable diameters for the interior of the mixing tube 90 would be from about 1.0 inches to about 3.0 inches. Preferable combinations of orifices 74 and mixing tube diameter 90 would be, for example, 0.25 inches constriction and 1.04 inch mixing tube diameter; 0.450 inch constriction with about 1.87 inch diameter of the mixing tube 90; and for example, 0.65 inch diameter constriction with a mixing tube diameter of about 2.70 inches. The most preferable combination of constriction and mixing tube diameter is about 0.45 inches and a 1.5 inch diameter within the mixing tube, when employed with 125 PSI air supply using approximately 335 cfm produces approximately 15 inches mercury of reduced pressure, and will consume approximately 600 cfm through a four inch vacuum connector 56.

In a further embodiment of the present invention, the nozzle 24 and mixing tube 26 may be interchanged with other substitute nozzles and mixing tubes. Preferably, the induction vacuum of this embodiment is supplied as kit, including: a body, a selection or set of several nozzles and several mixing tubes and one or preferably several exhaust bells. Preferably, the interchangeable members of the sets, (i.e., the nozzle and mixing tube combinations) each include identifying indicia to facilitate selection of a appropriate nozzle and mixing tube pair. The kit may also include appropriate instructions and selection suggestions for various applications. The substitution of nozzles and mixing tubes, preferably as matched pairs, allows versatility to be incorporated in an induction vacuum since the vacuum may be altered to best match a particular high pressure air supply and vacuum requirements. Additionally, should the induction require repair of a worn or damaged nozzle 24 or mixing tube 26, easy removal and substitution may be achieved. Although the present invention has been described with reference to the preferred embodiments, workers skilled in the art will recognize that changes may be made in form and detail without departing from the spirit and scope of the invention.

What is claimed is:

1. An induction vacuum for generating vacuum from a source of high pressure air comprising:

a cylindrical body, having an inlet plate, and outlet plate, and a vacuum connector;

a nozzle adapted to be connected to the source of pressurized air, the nozzle detachably mountable to the inlet plate for discharge of high pressure air within the body;

a mixing tube having an inlet end for receiving air discharge from the nozzle and any entrained material and air entering the body through the vacuum connector, the inlet end of the mixing tube projecting into the body to cooperate with the nozzle and having an outlet end detachably mountable to the outlet plate; and an exhaust bell detachably mountable to the mixing tube.

2. The induction vacuum of claim 1, wherein the nozzle includes:

a mounting plate; and a protuberance having an axial passage to a discharge orifice.

3. The induction vacuum of claim 2 wherein the nozzle is an aluminum casting.

4. The induction vacuum of claim 1, wherein the mixing tube includes:

a mounting plate; and a tube projecting from the mounting plate, the tube having an axial passage and a flared intake opposite the mounting plate.

5. The induction tube of claim 1 wherein the body is steel.

6. The induction vacuum of claim 1 and further comprising:

means for mounting the nozzle to the inlet plate;

means for mounting the mixing tube to the outlet plate; and means for mounting the exhaust bell to the mixing tube.

7. An induction vacuum kit comprising:

cylindrical body having an inlet plate, an outlet plate and a vacuum connector;

a plurality of nozzles, each detachably mountable to the inlet plate;

a plurality of mixing tubes, each detachably mountable to the outlet plate;

at least one exhaust bell detachably mountable to the mixing tube;

means for mounting one of the plurality of nozzles to the inlet plate; and means for mounting one of the plurality of mixing tubes to the outlet plate and the exhaust bell to the one of the plurality of mixing tubes to be mounted.

8. The induction vacuum kit of claim 7 wherein each of the mixing tubes of the plurality and each of the nozzles of the plurality bear indicia for indicating the passage dimensions.

9. The induction vacuum kit of claim 8 and further comprising:

instructions for selection of a nozzle and a mixing tube.

10. An induction vacuum for generating vacuum from a source of high pressure air comprising:

a cylindrical body, having an inlet plate, an outlet plate, and a vacuum connector;

a nozzle adapted to be connected to the source of pressurized air, for discharge of high pressure air within the body, the nozzle detachably mountable to the inlet plate;

a cast aluminum mixing tube for receiving air discharge from the nozzle and any entrained matter and air entering the body through the vacuum connector, the mixing tube including:

a mounting plate; and a tube projecting from the mounting plate, and having an axial passage and a flared intake, the mixing tube detachably mountable to the outlet plate; and an exhaust bell detachably mountable to the mixing tube.

11. A device for generating suction from a flow of high pressure air, the device comprising:

an inlet plate attached to the first end of the body, the outlet plate having an aperture;

an outlet plate attached to the second end of the body, the outlet plate having an aperture;

a vacuum connecting tube attached to the cylindrical wall in communication with the aperture of the cylinder wall;

an air discharge nozzle, adapted to be connected to the source of pressurized air, the nozzle detachably mountable to the inlet plate, projecting into the body through the aperture of the inlet plate;

a mixing tube, detachably mountable to the outlet plate, projecting into the body through the aperture of the outlet plate; and an exhaust bell detachably mountable to the mixing tube when the mixing tube is mounted upon the outlet plate.

* * * * *